United States Patent [19]

Dunbar

[11] 4,355,833

[45] Oct. 26, 1982

[54] LIFTING APPARATUS

[76] Inventor: Glenn G. Dunbar, 2608 Overbrook, Toledo, Ohio 43614

[21] Appl. No.: 162,148

[22] Filed: Jun. 23, 1980

[51] Int. Cl.[3] ..... B66C 1/10

[52] U.S. Cl. ..... 294/87 R; 294/81 R; 294/67 BC

[58] Field of Search ..... 294/87 R, 81 R, 81 SF, 294/88, 93, 95, 97, 67 R, 67 B, 67 BA, 67 BB, 67 BC, 67 DA

[56] References Cited

U.S. PATENT DOCUMENTS 3,606,056 9/1971 Morgan ..... 294/81 R 4,136,903 1/1979 Roethler ..... 294/81 R

*Primary Examiner*—James B. Marbert

*Attorney, Agent, or Firm*—Emch, Schaffer & Schaub

[57] ABSTRACT

A lifting apparatus having at least one lifting hook pivotally attached to a support frame. The support frame is pivotally attached to a lifting bar which in turn is movably connected to a hoist means.

7 Claims, 5 Drawing Figures

FIG. 3
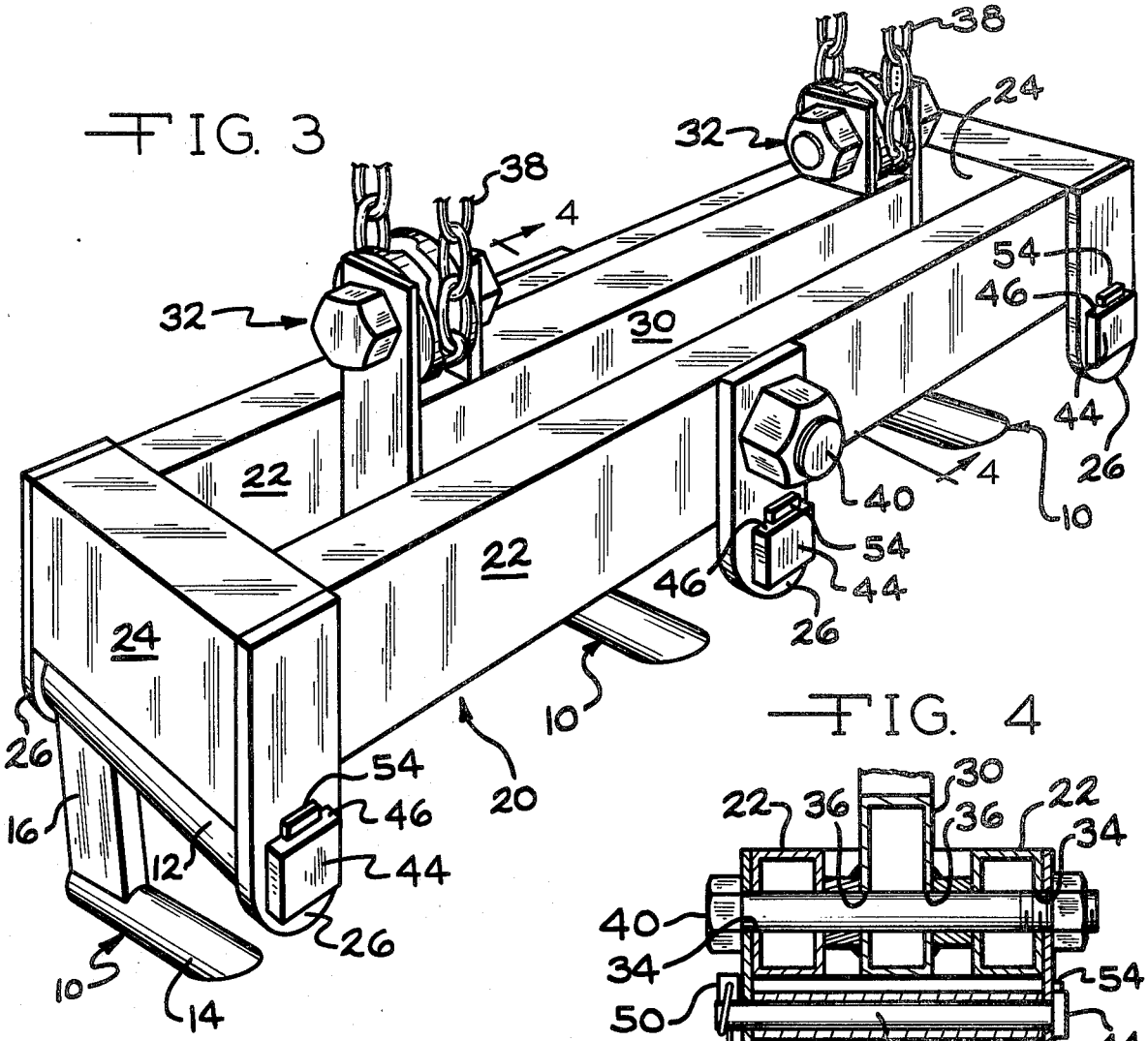
FIG. 4
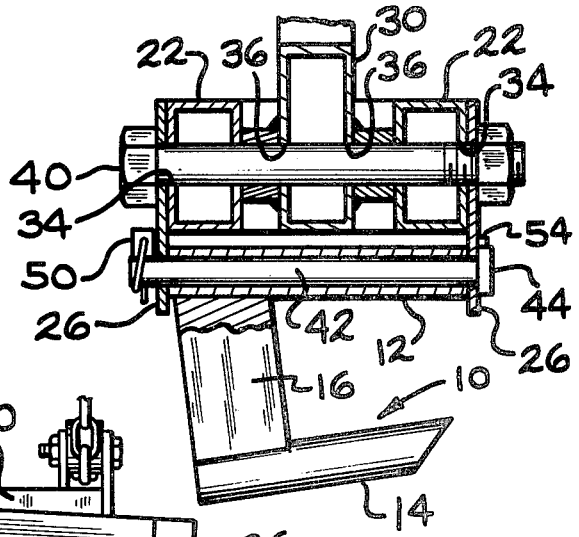
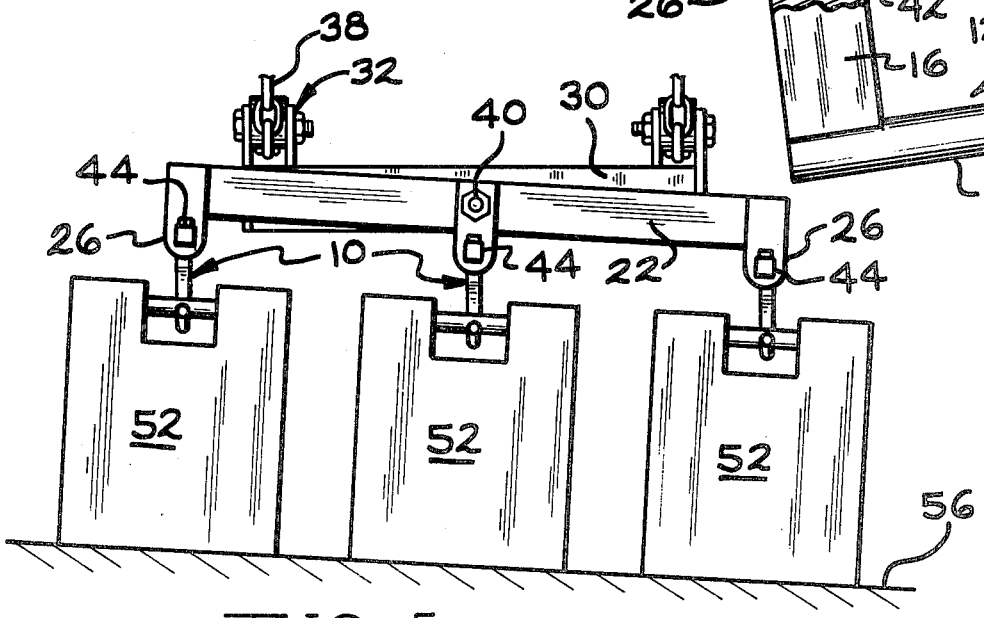
FIG. 5

LIFTING APPARATUS

BACKGROUND OF THE INVENTION

This invention is directed toward a lifting apparatus for moving specified objects by means of a hoist or crane. Specifically, the lifting apparatus is intended for use in moving specified calibration weight units from a weight carrying truck onto a scale-testing vehicle or a platform scale, for the purpose of calibrating the platform scale.

Platform scales are well known and are used in many applications. For example, platform scales are used by commercial enterprises which deal in large quantities of bulk materials, such as grain elevators. Similarly, government regulations create a demand for the use of platform scales to determine whether semitrailer and tractor units are in compliance with the highway load limits delineated by state vehicle weight limit enforcement programs. Common weight loads for platform scales generally range from twenty tons to one hundred tons.

Platform scales are often designed to combine a plurality of individual platforms by mechanical linkage or by electronic load cells. The series of individual platforms linked in series allows for greater ease and accuracy in weighing loads of differing sizes. For example, as a vehicle rests on one or more of the platforms, its weight will be accurately transmitted to the indicator through the mechanical linkage or electronic load cells.

Because of the applications in which platform scales are used, dirt and friction have a tendency to build up at critical points in the linkages, thereby restricting the action of the mechanisms. When this occurs, the scales do not indicate a weight which corresponds to the actual weight of the load. Similarly, drift in the components of electronic scales will affect their calibration, causing the reading to not correspond with the proper weight. In either event, overpayment or underpayment for a load of bulk material or mistakes in weighing a properly loaded vehicle are manifest.

It is important to periodically calibrate platform scales in order to counter the inefficiencies described above. In the past, platform scales have been tested by placing individual weight units, normally five hundred pound units or one thousand pound units, upon the individual platform sections of a scale. Obviously this method requires a considerable amount of time and manpower to unload the weights, test the scales and reload the weights onto the weight transporting vehicle.

To better facilitate the calibration, special vehicles have been designed to transport the calibration weights. As the scale site these weight carrying vehicles unload the calibration weights onto either the scale or a small scale testing cart which is capable of carrying a substantial quantity of calibration weights and is easily moveable about a platform scale. The special weight carrying vehicles are usually designed to have a self-contained weight transfer apparatus. The weight transfer apparatus has at least one hook which picks up the calibration weights and places them in the desired position. Applicant's invention relates to an improved lifting apparatus capable of moving a selected number of weights to their selected position.

SUMMARY OF THE INVENTION

The lifting apparatus of the present invention discloses a support frame having one or more lifting hooks pivotally attached. A lifting bar, is pivotally connected to the support frame. The lifting apparatus is connected to the weight transfer apparatus of the weight carrying vehicle by any desirable means, such as chain or cable.

The preferred embodiment of the lifting apparatus of the present invention discloses three lifting hooks that are pivotally attached to the support frame. This pivotal characteristic allows for the movement of various selected combinations of calibration weights; i.e. two calibration weights can be lifted by the outside lifting hooks, one calibration weight alone can be lifted by the inside lifting hook, or three calibration weights can be lifted by all three hooks.

The preferred pivotal characteristic of the support frame in conjunction with the lifting bar allows for the calibration weights to be moved to or from an uneven surface without throwing the weight transfer apparatus out of balance.

Therefore, it is a primary object of this invention to provide a lifting apparatus capable of moving selected calibration weights.

Another object of the invention is to provide a lifting apparatus that can pick up and move calibration weights from an uneven surface without seriously throwing the weight transfer apparatus off balance.

Other objects and advantages of the invention will become apparent in the following detailed description of the preferred form thereof, reference being had to the accompanying drawings.

BRIEF DESCRIPTION OF THE DRAWINGS

FIG. 3 is a perspective view of the lifting apparatus constructed in accordance with the present invention.

FIG. 4 is a cut away view along line 4—4 of FIG. 3.

FIG. 5 is a front elevation view of the lifting apparatus of the present invention engaging calibration weights located on an uneven surface.

DETAILED DESCRIPTION OF THE DRAWING

Figure 1:
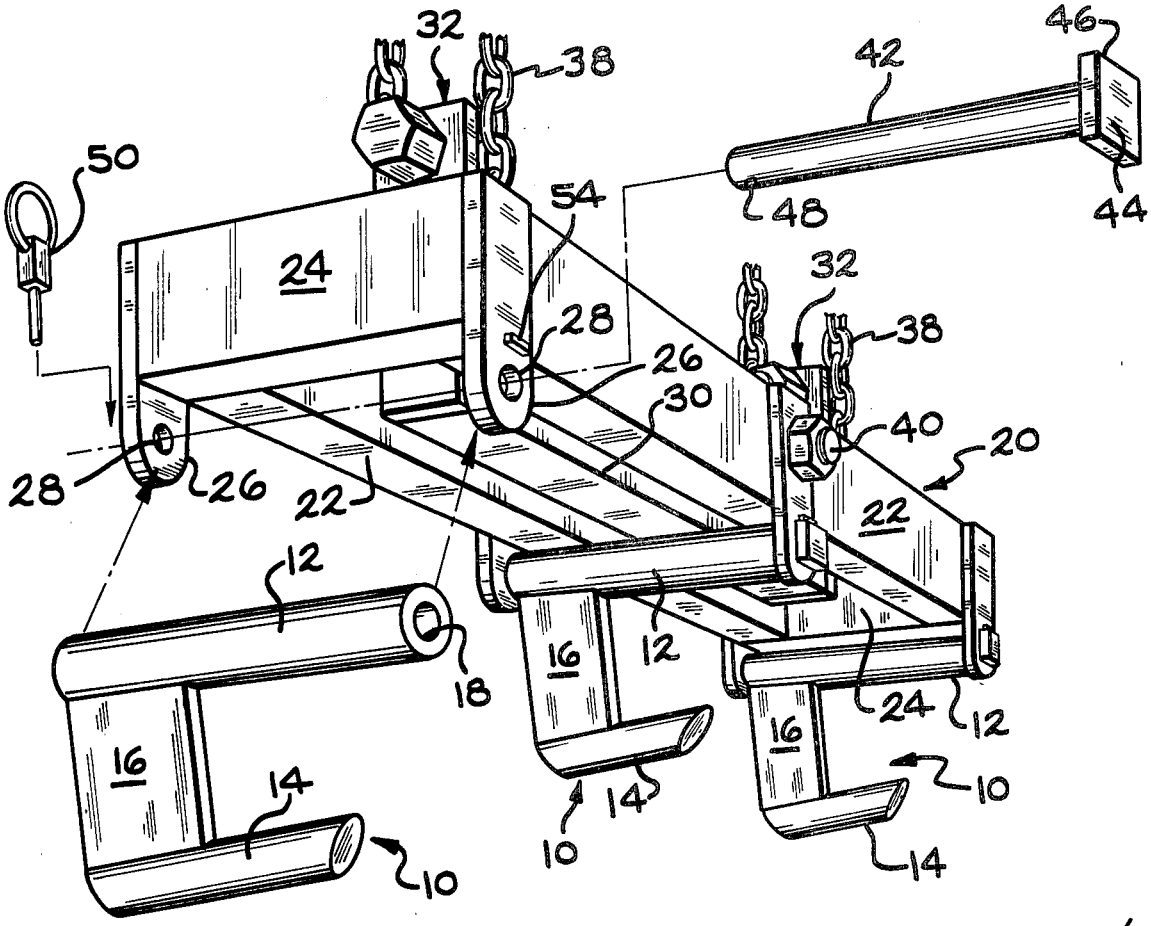
FIG. 1 is a perspective view of the lifting apparatus constructed in accordance with the present invention.

The lifting apparatus as illustrated in the drawings generally discloses at least one lifting hook 10 which is pivotally connected to a support frame 20. The support frame 20 is pivotally attached to a lifting bar 30 which in turn is connected by any suitable means, such as cables or chains 38, to a weight transfer device (not shown). In the preferred embodiment, there are three lifting hooks 10 equally spaced across the support frame 20. Each lifting hook 10 will accommodate a separate calibration weight 52. Each calibration weight 52 is designed to receive the lifting hooks 10 and the calibration weight units 52 are spaced apart on the bed of the vehicle 60 so as to receive the lifting hooks 10 as the lifting apparatus is lowered by the weight transfer device.

Referring to FIGS. 1–4 of the accompanying drawings, the support frame 20 includes two laterally disposed side members 22 which are in opposed relationship and substantially parallel to one another. Two end members 24 are disposed between the adjacent ends of the opposed side members 22. The resultant structure, as shown in FIGS. 1 and 3, is a four-sided frame which is open in the center.

Three pairs of opposed flanges 26 project from the side members 22. Each pair of flanges 26 is fixed in opposed relationship to the opposed side walls, with one pair of flanges 26 located adjacent each end member 24 and the third pair of flanges 26 located at the center point of the side members 22. Each pair of opposed flanges 26 define opposed flange apertures 28 in the ends of the flanges 26 which project from the side members 22. The flange apertures 28 located in each pair of flanges 26 are in substantial alignment. Positioned directly adjacent the flange aperture 28 contained in one flange 26 of each pair of flanges 26 is an upraised boss 54.

The support frame 20 is pivotally attached to a lifting bar 30. The lifting bar 30 is movably attached to the weight transfer apparatus by chains or cables 38. The chains or cables 38 interconnect with the lifting bar 30 by means of standard sprocket or pulley units 32 which are fixed to the lifting bar 30. The sprocket or pulley unit 32 is of common design to accommodate the chosen type of lifting means 38; i.e. cable or chain.

A pair of aligned side-member apertures 34 are defined in the opposed side members 22 of the support frame 20 at their lateral center point. A lift bar aperture 36 is located at the lateral center point of the lifting bar 30. The side member apertures 34 in the support frame 20 are in substantial alignment with the lift bar aperture 36 in the lifting bar 30. A bolt 40 is located in the aligned side member and lift bar apertures 34, 36 to pivotally attach the support frame 20 to the lifting bar 30.

Each of the lifting hooks 10 includes a generally U-shaped member with two substantially opposed legs 12, 14 joined at their adjacent ends by a spacer 16. The first leg 12 defines a lateral aperture 18 which extends along the centerline of the first leg 12. The second leg 14 is angularly disposed with respect to the first leg 12 and converges toward the first leg 12 as it extends from the spacer 16.

The lifting hooks 10 are pivotally positioned between the opposed flanges 26. The lateral apertures 18 in the first legs 12 are substantially aligned with the flange apertures 28 located in the opposed flanges 26. A rod 42 is positioned in the aligned flange and lateral apertures 18, 28 so that the lifting hook 10 is pivotally attached to the support frame 20.

The rod 42 has a head 44 on one end with at least one flat side 46 which engages the boss 54 located on the flange 26 so that the rod 42 cannot rotate. The opposed end of the rod 42 extends past the second of the opposed flanges 26. An O-ring clevis 50 is positioned on the rod aperture 48 to secure the rod 42 between the opposed flanges 26 so that the lifting hook 10 can freely pivot on the support frame 20.

In operation the lifting apparatus is positioned over the calibration weights 52. The lifting apparatus is then lowered by advancing the chains 38 that are positioned around the pulley unit 32 on the lifting bar 30. The lifting apparatus is lowered until the lifting hooks 10 are in position to engage the lifting means on the calibration weights 52. The calibration weights 52 are engaged by the second leg 14 of the hooks 10. Once the calibration weights are securely positoned on the second legs 14 the weights can be raised or lowered by advancing the chains 38 around the pulley units 32. The calibration weights can also be laterally displaced by providing additional means (not shown) for moving the lifting apparatus and the calibration weights.

Figure 2:
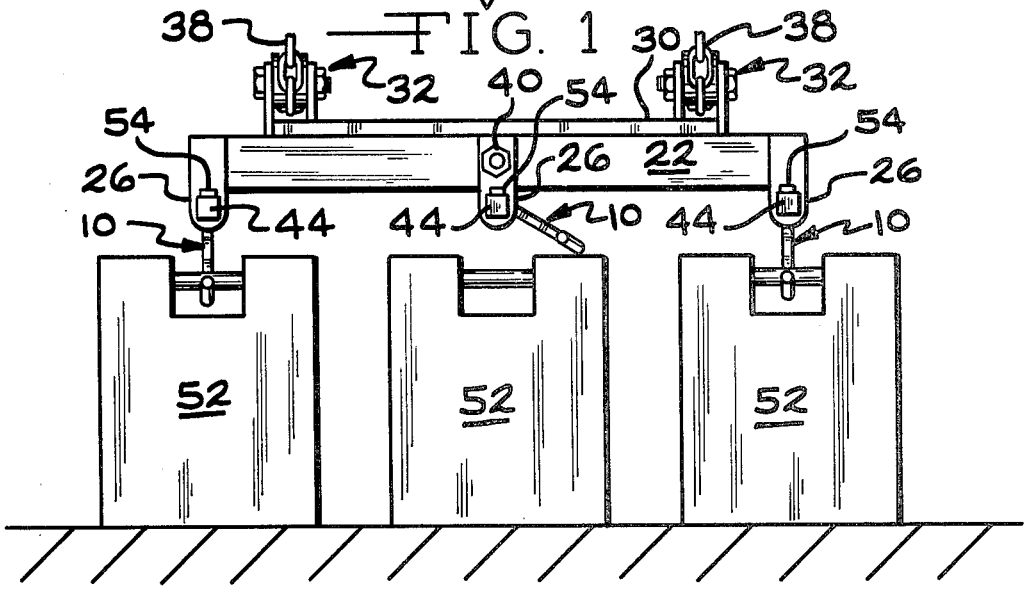
FIG. 2 is a front elevation view of the lifting apparatus of the present invention with the center lifting hook disengaged.

The hooks 10 pivot with respect to the frame 20 to facilitate the positioning of the hooks in engagement with the calibration weights 52. When the lifting apparatus has been lowered to the position where the hooks can engage the calibration weights, the hooks can be pivoted or moved to further facilitate the positioning of the hooks in engagement with the calibration weights. In addition, as shown in FIG. 2, the hooks can be pivoted so that all the hooks do not engage the lifting means on the calibration weights. Accordingly, various selected combinations of the calibration weights can be engaged by the hooks on the lifting apparatus. For example, two calibration weights can be lifted by the outside lifting hooks, one calibration weight can be lifted by the center lifting hook, or three calibration weights can be lifted by the three hooks positioned on the frame 20.

The lifting bar 30 is also pivotally attached to the support frame 20. Thus, the lifting bar 30 is free to pivot with respect to the frame 20 around the bolt 40. The pivotal relationship between the lifting bar 30 and frame 20 allows the lifting apparatus to have additional flexibility in handling calibration weights. If the calibration weights are positioned on a non-level surface, as shown in FIG. 5, the frame 20 can pivot with respect to the lifting bar 30 so the calibration weights can be engaged and moved without disturbing the balance of the lifting apparatus. In addition, the pivoting of the hooks 10 will assist in allowing the hooks to engage the lifting means on the calibration weights when the weights are positioned on a non-level surface. However, it should be noted that the calibration weights 52 must be evenly distributed on the lifting hooks to prevent the lifting apparatus from becoming unbalanced.

It will be appreciated that other arrangements of the lifting apparatus may be used and that changes may be made in the elements of the lifting apparatus without departing from the scope of the following claims.

What I claim is:

1. Apparatus for lifting a load comprising: a support frame having a pair of laterally disposed side members, said side members being spaced apart in opposed relationship and substantially parallel, said support frame further including at least two flanges extending from said frame, said flanges being in opposed relationship, at least one lifting hook pivotally attached to said support frame for engaging said load, each of said lifting hooks including a generally U-shaped member having a first leg and an opposed second leg, said second leg being fixed to said first leg by a spacing member, said first leg of said U-shaped member being pivotally positioned between said opposed flanges, a lifting bar pivotally connected to said support frame; and means for lifting said lifting apparatus, said lifting means being connected to said lifting bar whereby said lifting bar can pivot with respect to said frame to balance said load.

2. The lifting apparatus of claim 1 wherein said second leg of said lifting hook is angularly disposed to said first leg, said second leg converging towards said first leg as said second leg extends from said spacing member.

3. The lifting apparatus of claim 1 wherein said lifting bar defines a lift bar aperture at its lateral centerpoint.

4. The lifting apparatus of claim 3 wherein said opposed side members define opposed side member apertures at the lateral center-point of said side members, said opposed side member apertures being substantially in alignment.

5. The lifting mechanism of claim 4 wherein said lifting bar is positioned between said opposed side members, said lift bar aperture of said lifting bar being in substantial alignment with said side member apertures of said opposed side members; and a bolt positioned in said aligned aperture to pivotally attach said support frame to said lifting bar.

6. A lifting apparatus for lifting calibration weights for calibrating scales comprising:

a support frame, said frame including a pair of laterally disposed substantially parallel side members, said side members being spaced apart in opposed relationship, said side members defining an aperture at substantially the lateral center point of said members, said apertures being substantially in alignment;

a lifting bar positioned between said opposed side members, said lifting bar defining an aperture at substantially the lateral center point of said bar, said aperture in said lifting bar being substantially in alignment with said apertures in said side members of said support frame;

a rod positioned in said apertures in said side members and said aperture in said lifting bar to pivotally connect said lifting bar to said support frame;

at least one lifting hook pivotally attached to said support frame for engaging said calibration weights, said lifting hook including a generally u-shaped member having a first leg pivotally connected to said support frame, an opposed second leg spaced apart from said first leg, said second leg connected to said first leg by a spacing member, said second leg converging towards said first leg as said second leg extends from said spacing member; and means for lifting said support frame, said lifting means being connected to said lifting bar whereby said lifting bar can pivot with respect to said frame to balance said calibration weights.

7. A lifting apparatus comprising: a support frame having a pair of laterally disposed side members, said side members being spaced apart in opposed relationship and substantially parallel, two end members disposed between the adjacent ends of said opposed side members, said support frame further including at least two flanges extending from said frame, said flanges being in opposed relationship and defining opposed flange apertures, said flange apertures being substantially in alignment; at least one lifting hook pivotally attached to said support frame, each of said lifting hooks including a generally U-shaped member having a first leg and an opposed second leg, said second leg being fixed to said first leg by a spacing member, said first leg of said U-shaped member defining a lateral aperture, said aperture extending along the center line of said first leg, said first leg of said U-shaped member being pivotally positioned between said opposed flanges, said opposed flange apertures of said flanges and said lateral aperture of said first leg being in alignment, a rod being positioned in said aligned flange and lateral apertures to pivotally attach said U-shaped member to said support frame; a lifting bar pivotally connected to said support frame; and means for lifting said lifting apparatus, said lifting means being connected to said lifting bar whereby said lifting bar can pivot with respect to said frame to balance said load.

* * * * *